US007963370B2

(12) United States Patent
Hwang

(10) Patent No.: US 7,963,370 B2
(45) Date of Patent: Jun. 21, 2011

(54) SYSTEM AND APPARATUS FOR PERSONAL HIGH ALTITUDE RAPPEL ESCAPE SAFETY DEVICE

(76) Inventor: Byung-Sun Hwang, Austin, TX (US)

( * ) Notice: Subject to any disclaimer, the term of this patent is extended or adjusted under 35 U.S.C. 154(b) by 592 days.

(21) Appl. No.: 11/562,469

(22) Filed: Nov. 22, 2006

(65) Prior Publication Data

US 2011/0067956 A1 Mar. 24, 2011

Related U.S. Application Data

(60) Provisional application No. 60/739,490, filed on Nov. 23, 2005.

(51) Int. Cl.
*A62B 1/08* (2006.01)

(52) U.S. Cl. ..... 182/240; 182/236; 182/70; 182/72

(58) Field of Classification Search ..... 182/70, 182/72, 73, 75, 236, 240, 235; 188/72.9
See application file for complete search history.

(56) References Cited

U.S. PATENT DOCUMENTS

| | | | | | |
|---|---|---|---|---|---|
| 300,622 | A | * | 6/1884 | Mickle | 182/240 |
| 304,603 | A | * | 9/1884 | Bott | 182/5 |
| 656,507 | A | * | 8/1900 | Brown | 182/236 |
| 899,984 | A | * | 9/1908 | Huffman et al. | 188/65.3 |
| 2,500,884 | A | | 3/1950 | Tessin | |
| 2,550,235 | A | | 4/1951 | Duncan, Jr. | |
| 2,561,832 | A | * | 7/1951 | Wilson | 182/235 |
| 2,585,876 | A | | 2/1952 | Thoennes | |
| 2,729,425 | A | | 1/1956 | Gschwind | |
| 4,102,431 | A | | 7/1978 | Carroll et al. | |
| 4,171,795 | A | * | 10/1979 | Bianchi | 182/236 |
| 4,286,690 | A | | 9/1981 | Gastine | |
| 4,301,892 | A | * | 11/1981 | Arce | 182/233 |
| 4,311,218 | A | * | 1/1982 | Steffen | 188/65.4 |
| 4,662,475 | A | | 5/1987 | Riitschi et al. | |
| 4,714,135 | A | | 12/1987 | Bell et al. | |
| 4,938,435 | A | | 7/1990 | Varner et al. | |
| 5,107,956 | A | | 4/1992 | Constantinis et al. | |
| 5,131,491 | A | * | 7/1992 | Varner et al. | 182/7 |

(Continued)

FOREIGN PATENT DOCUMENTS

JP 62-170059 U 10/1987

(Continued)

OTHER PUBLICATIONS

Lattice. (2010). In Merriam-Webster Online Dictionary. Retrieved Apr. 12, 2010, from http://www.merriam-webster.com/dictionary/lattice.*

(Continued)

*Primary Examiner* — Katherine Mitchell
*Assistant Examiner* — Daniel Cahn
(74) *Attorney, Agent, or Firm* — Bracewell & Giuliani LLP

(57) ABSTRACT

A personal, lightweight, high altitude rappel escape safety device is worn by an individual as a backpack and provides a safe means of lowering the individual from an elevated structure. The device comprises a structural body containing a mechanical device for slowly releasing a high strength cable. One end of the cable is secured to the structure prior to the user descending from the structure. The cable is released from a spool located inside the body and makes a circuitous path though a frictional structure. The structure contains baffles through which the cable extends. The friction caused by the pattern of release of the cable generates sufficient drag to safely lower a person from any altitude in a structure to the ground. The rate of descent may be adjusted via a braking mechanism.

6 Claims, 5 Drawing Sheets

U.S. PATENT DOCUMENTS

| | | | | |
|---|---|---|---|---|
| 5,145,028 | A * | 9/1992 | Wai | 182/5 |
| 5,682,962 | A * | 11/1997 | Lo | 182/240 |
| 5,842,542 | A * | 12/1998 | Tien | 182/231 |
| 5,868,219 | A | 2/1999 | Sadeck et al. | |
| 6,029,777 | A * | 2/2000 | Rogelja | 182/193 |
| 6,223,868 | B1 * | 5/2001 | Wullimann | 188/188 |
| D490,135 | S * | 5/2004 | Henson | D21/805 |
| 6,832,668 | B2 * | 12/2004 | Henson | 182/236 |
| 6,962,238 | B1 * | 11/2005 | Ostrobrod | 182/193 |
| 6,988,589 | B2 * | 1/2006 | Ribic | 182/235 |
| 2004/0118636 | A1 * | 6/2004 | Henson | 182/236 |
| 2004/0245048 | A1 * | 12/2004 | Ribic | 182/231 |

FOREIGN PATENT DOCUMENTS

| | | |
|---|---|---|
| KR | 10-2005-0098325 | 7/2007 |
| WO | WO 90/04998 | 5/1990 |
| WO | WO9004998 | 5/1990 |

OTHER PUBLICATIONS

The American Heritage® Dictionary of the English Language, Fourth Edition copyright © 2000 by Houghton Mifflin Company. Updated in 2009. Published by Houghton Mifflin Company. All rights reserved. definition of 'along' found in Office Action.*

The American Heritage® Dictionary of the English Language, Fourth Edition copyright © 2000 by Houghton Mifflin Company. Updated in 2009. Published by Houghton Mifflin Company. All rights reserved. defintiion of 'clasp' found in Office Action.*

Abstract of Korean Application No. 10-2007-0045919 with translation, (co-pending application).

Abstract of co-pending Korean Issued Patent.

* cited by examiner

SYSTEM AND APPARATUS FOR PERSONAL HIGH ALTITUDE RAPPEL ESCAPE SAFETY DEVICE

This application claims priority to and the benefit of U.S. Provisional Patent Application Ser. No. 60/739,490, filed on Nov. 23, 2005, and is incorporated herein by reference.

BACKGROUND OF THE INVENTION

1. Technical Field

The present invention relates in general to personal safety devices and, in particular, to an improved system and apparatus for providing a safe means of escape from an elevated structure when there is imminent danger and no other optional escape means.

2. Description of the Related Art

Many deaths result each year from fires in tall buildings in which people are trapped on floors that are too high to be reached by fire truck ladders. There have been many proposed solutions over the years to provide better fire escape devices. One common proposal utilizes small portable drums having cables that are located on the higher floors of tall buildings for emergency use. Should a fire or other emergency occur, the user of the drum breaks a window, secures the free end of the cable to an anchor in the building, and is then lowered to the ground or a safe level.

One deficiency with some of these prior art solutions, such as U.S. Pat. No. 2,409,767, is that the user must adjust a friction type brake to control the speed of descent. Should the user panic or be unconscious, an accident may occur. Other proposals disclose automatic governors for speed, such as the solution shown in U.S. Pat. No. 2,500,884, which utilizes a fluid restricting device that requires reverse winding of the cable and the drum at periodic points, and U.S. Pat. No. 4,063,615, which utilizes a centrifugal friction type governor in which additional speed control appears to be required through manual operation of a conventional brake band. Thus, an improved solution for providing a safe means of escape from an elevated structure when there is imminent danger and no other optional escape means would be desirable.

SUMMARY OF THE INVENTION

One embodiment of a system and apparatus for a personal, lightweight, high altitude rappel escape safety device is disclosed. The device is worn by an individual as a backpack and provides a safe means of lowering an individual from an elevated structure. The device comprises a structural body containing a mechanical device for slowly releasing a high strength cable. One end of the cable is secured to the structure prior to the user descending from the structure. The cable is released from a spool located inside the body and makes a circuitous path though a frictional structure. The structure contains baffles having apertures through which the cable extends. The friction caused by the pattern of release of the cable through the baffles generates sufficient drag to safely lower a person from any altitude in a structure to the ground.

In another embodiment, an even slower rate of descent is achieved by the wearer of the device via a braking mechanism. The braking mechanism comprises a frictional brake that selectively engages the rotating spool. The user operates a brake handle that causes the brake to press against the spool to slow its rate of rotation, and thereby decrease the rate of release of the cable. The harder the user pulls on the handle, the slower he or she will descend from the structure.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
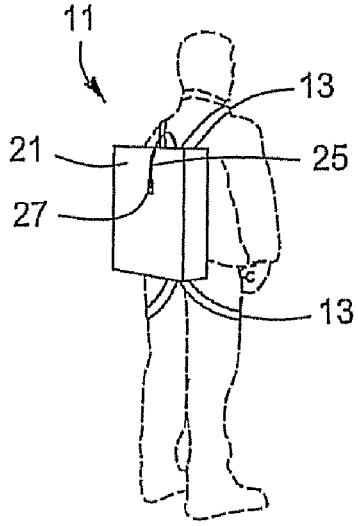
FIG. 1 is an isometric view of one embodiment of a safety device constructed in accordance with the present invention.
Figure 4:
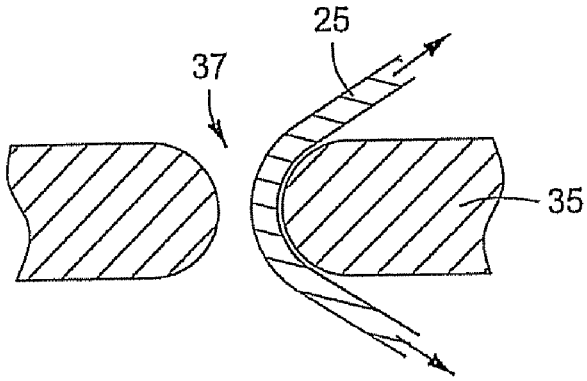
FIG. 4 is an enlarged sectional view of one embodiment of a cable aperture utilized by the safety device of FIG. 1 taken along section line 4 and is constructed in accordance with the present invention.
Figure 5:
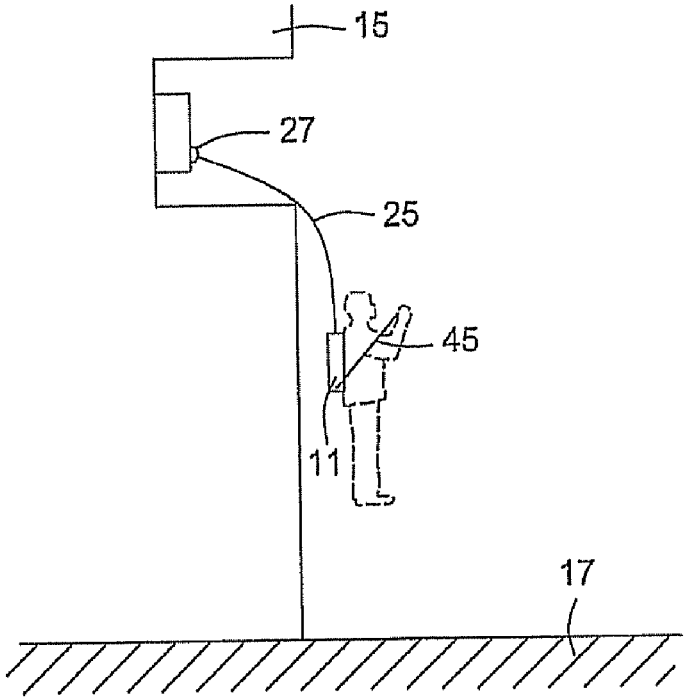
FIG. 5 is a schematic view of the safety device of FIG. 1 in operation.

Referring to FIGS. 1-5, one embodiment of a personal, lightweight, high altitude rappel escape safety device 11 constructed in accordance with the present invention is shown. As shown in FIGS. 1 and 5, device 11 is designed to be worn by an individual as a "backpack-style" accessory. However, device 11 also may be worn as a front pack and located in still other configurations on one's body and still accomplish its intended purpose, which is to provide a safe means of lowering an individual from an elevated structure 15. The invention is typically used in an emergency-type situation, such as a means of last resort when there is imminent danger in a high rise building and there is no other safe means of escape therefrom.

Device 11 is designed to be secured to an individual with a multi-point safety harness 13 as shown, for example, in FIG. 1. In the embodiment shown, harness 13 comprises numerous straps, clasps, buckles, etc., that attach and secure to the arms, legs, and torso of the wearer of device 11. The illustrated design provides a safe descent for the wearer of device 11 such that the wearer is ensured of landing on his or her feet, while minimizing the risk of tumbling or otherwise losing control of one's body position or orientation relative to the surface 17 (FIG. 5) upon which the wearer lands after the descent.

Referring again to FIG. 1, one embodiment of device 11 comprises a small, lightweight, structural body 21. Although body 21 is shown in a rectangular configuration, many other designs and sizes may be used. Body 21 is a hollow shell (FIGS. 2 and 3) having an interior chamber 23 in which is located a mechanical device for slowly releasing (e.g., via friction) a long, high strength cable 25 from therein. Alternatively, two or more cables 25 may be used for additional safety. Structural body 21 is provided with means for accessing the interior 23 thereof, such as hinged door (see, e.g., FIG. 1), etc.

A releasable locking device 27 (FIGS. 1 and 3) such as, e.g., a clasp or carabineer, is secured to the outer end of cable 25. As shown in FIG. 5, locking device 27 is designed to be secured to a strong reliable "anchor" in structure 15 (or, e.g., looped through an anchor and secured to cable 25) prior to leaping from the structure 15. Suitable anchors include any permanently secured or very heavy object located in structure 15 that is easily capable of supporting the weight of a heavy person that leaps from the structure 15.

Referring again to FIGS. 2 and 3, cable 25 is released from body 21 through a central hole 29 located at in the upper surface of body 21. Inside chamber 23 is located a permanently mounted, rotatable spool 31 on which the cable 25 is wound. The opposite end of cable 25 is permanently secured to spool 31. The length of cable 25 wound on spool 31 may be selected for whatever height or elevation from which escape may be required.

Figure 2:
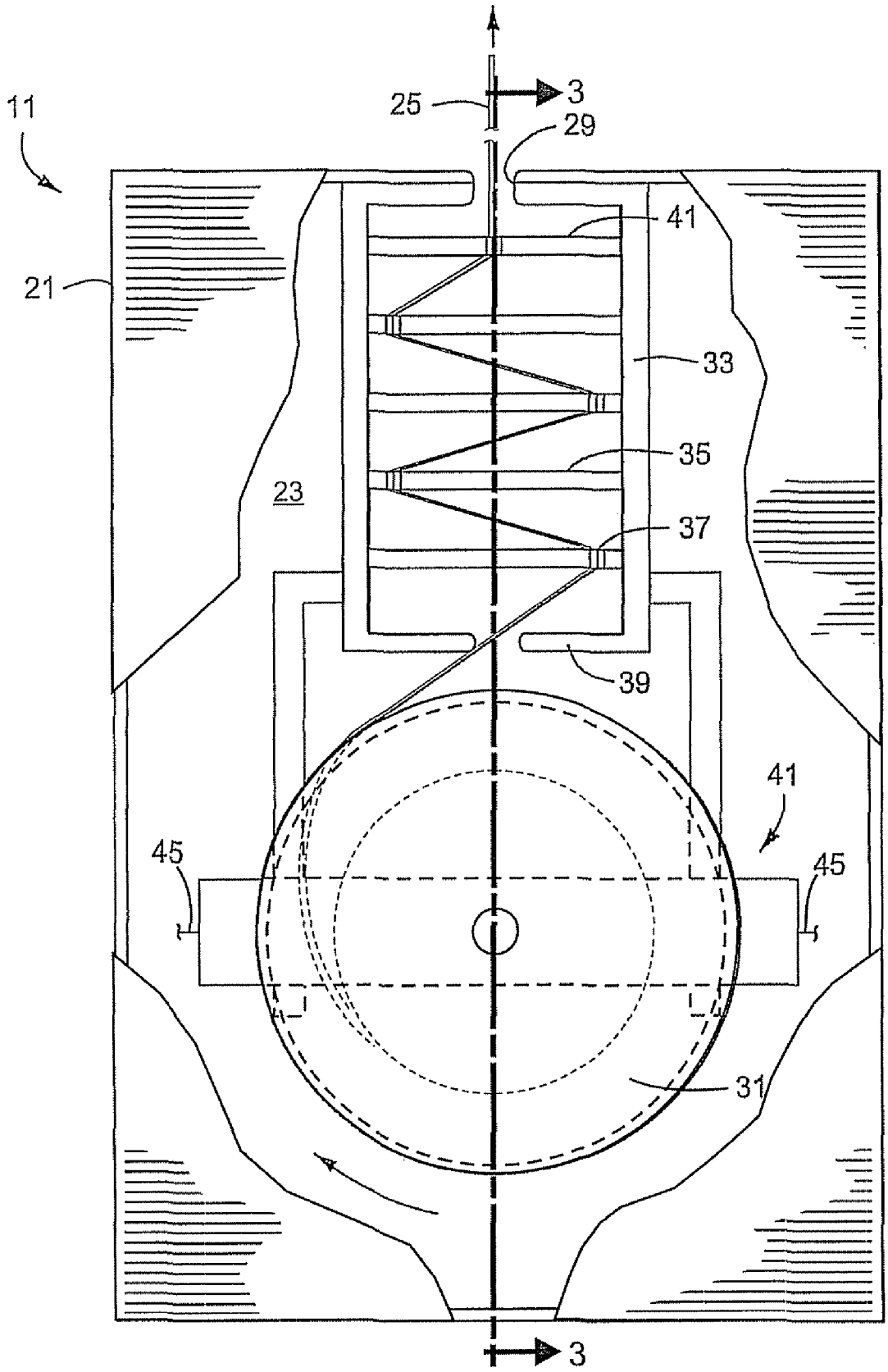
FIG. 2 is a front view of an interior of the safety device of FIG. 1 and is constructed in accordance with the present invention.

The cable extends continuously from spool 31 to locking device 27, but first must make a circuitous or labyrinthine path though a strong, friction-inducing structure 33. In the embodiment shown, structure 33 comprises a rectangular box having a plurality of horizontal, parallel baffles 35 that are vertically spaced apart from each other and rigidly secured in structure 33. Each of the thick, resilient baffles 35 is provided with one aperture 37 through which the continuous cable 25 extends. As shown in FIG. 2, the apertures 37 are located on alternating lateral sides of structure 33.

In one embodiment (FIG. 4), each aperture 37 has smooth rounded edges to avoid any damage to cable 25. This design also increases the surface area contact (and, thus, friction) with cable 25. In addition, the lowermost and uppermost baffles 39, 41 (FIGS. 2 and 3) are provided with central apertures 37 to facilitate release of cable 25 from spool 31 and out of body 21, respectively. The friction caused by the zigzag pattern of release of cable 25 through apertures 37 in baffles 35 generates sufficient friction to safely lower a person from any altitude in a structure 15 (FIG. 5) to the ground 17.

Figure 3:
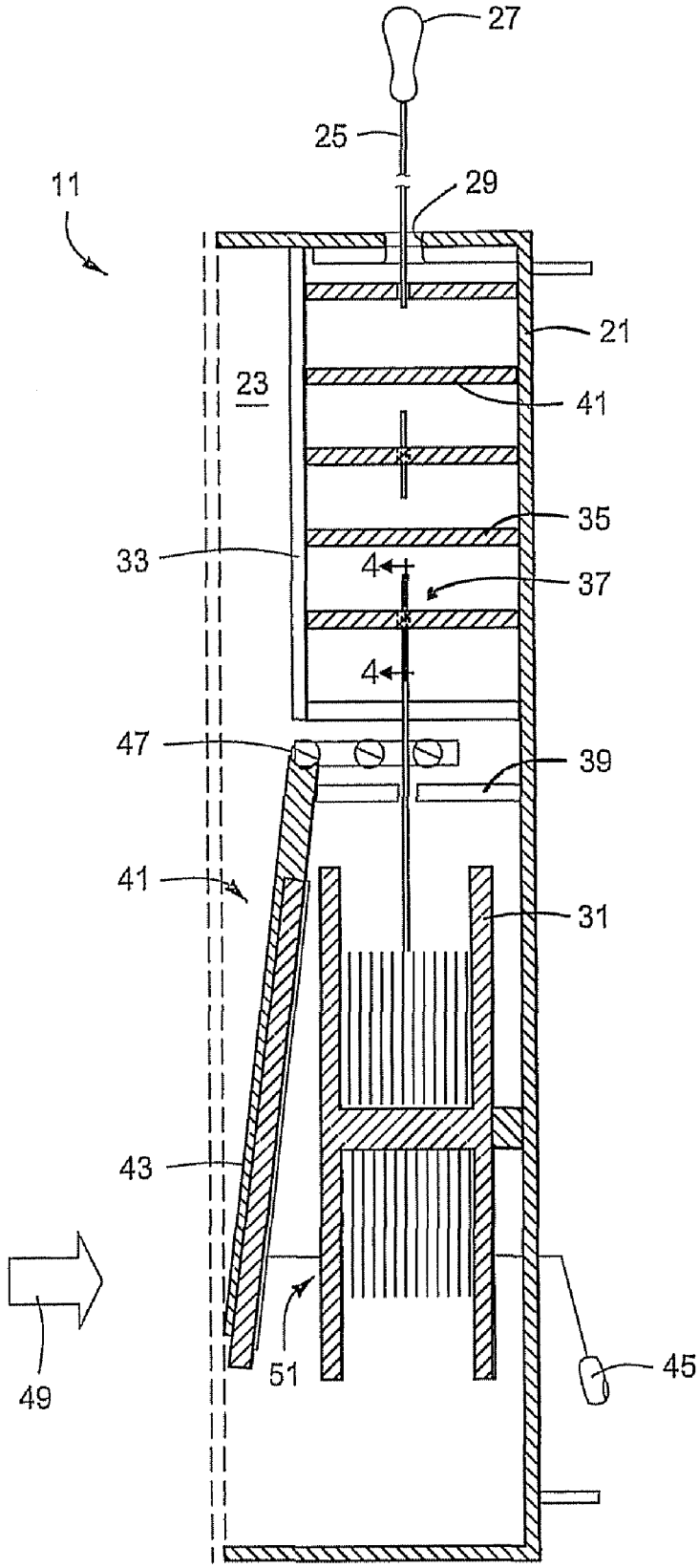
FIG. 3 is a partially sectioned side view of the interior of the safety device of FIG. 1 taken along a section line 3 coincident with a cable therein, and is constructed in accordance with the present invention.

In the event that an even slower rate of descent from structure 15 is desired by the wearer of device 11, device 11 may be equipped with a braking mechanism 41 (FIGS. 2 and 3). In one embodiment, braking mechanism 41 comprises a simple, friction-inducing brake 43 that selectively engages the rotating spool 31. The wearer of device 11 is provided with one or more brake handles 45 (e.g., short pull cables) that cause brake 43 to pivot 47 (FIG. 3) and press against (see arrow 49) a surface 51 of spool 31. When the wearer of device 11 pulls handle(s) 45 in the direction of arrow 49, the brake 43 engages the spool 31 to slow its rate of rotation, and thereby decrease the rate of release of cable 25. The harder the wearer of device 51 pulls on handle(s) 45, the slower he or she will descend from structure 15 (FIG. 5).

Figure 6:
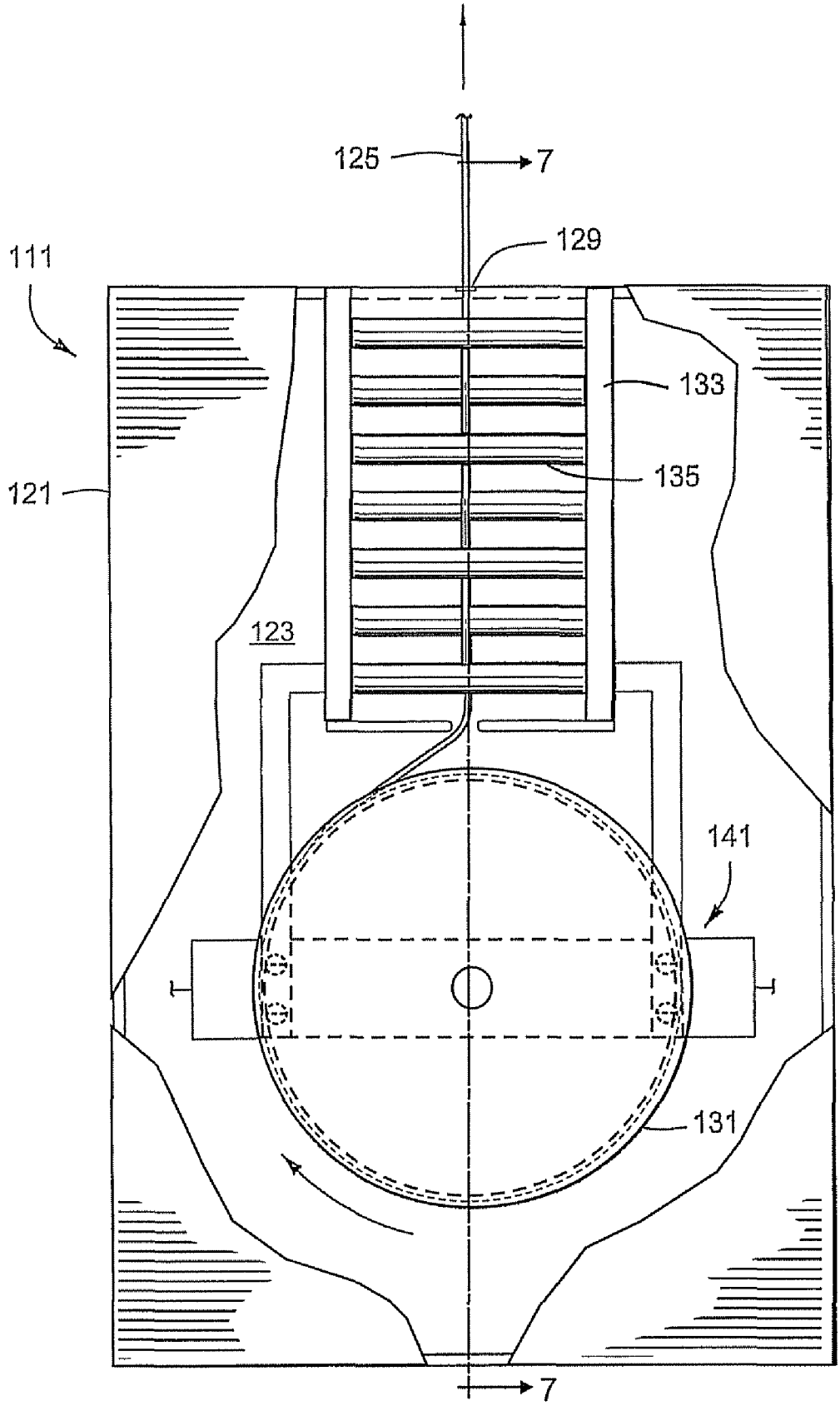
FIG. 6 is a front view of an interior of another embodiment of a safety device constructed in accordance with the present invention.
Figure 7:
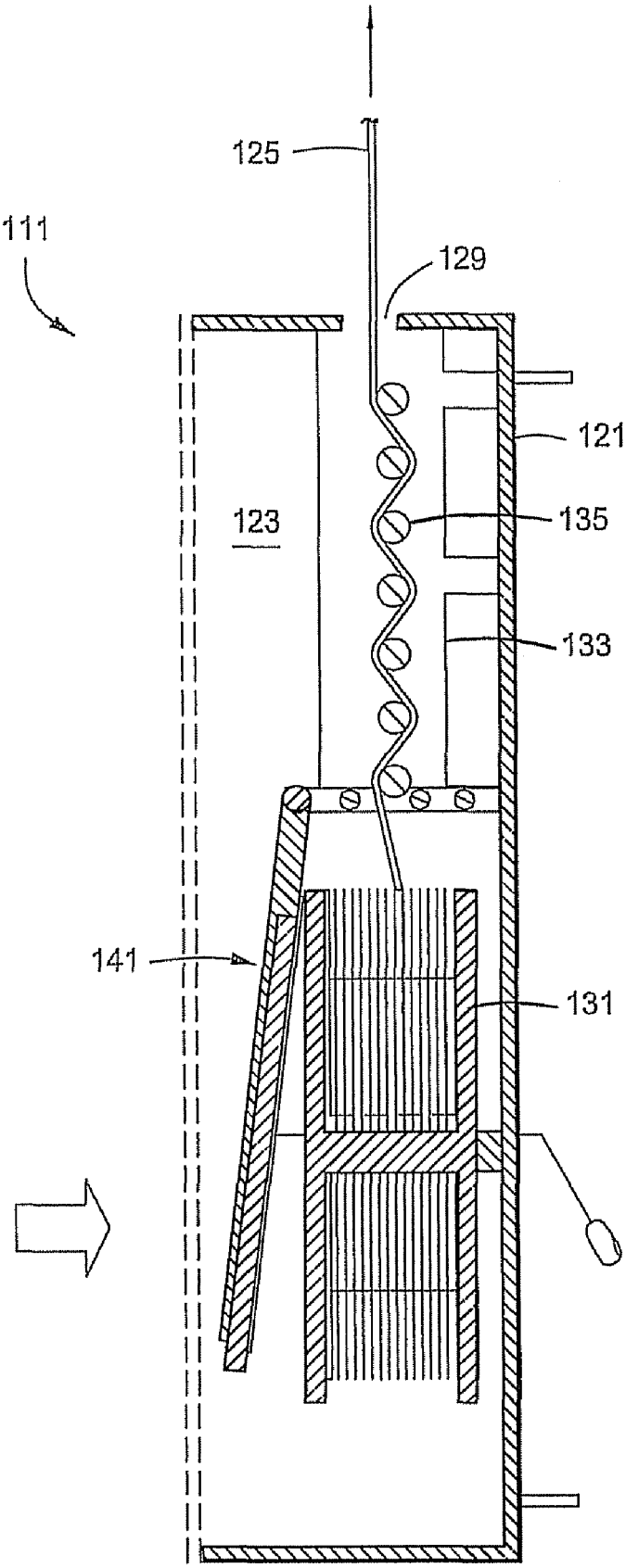
FIG. 7 is a partially sectioned side view of the interior of the safety device of FIG. 6 taken along a section line 7 coincident with a cable therein and is constructed in accordance with the present invention

Referring now to FIGS. 6 and 7, another embodiment of the present invention is shown as safety device 111. Device 111 is virtually identical to device 11 except for the way in which it slows the descent of its user. Thus, the same features and advantages described above for device 11 are also applicable to device 111 except for the differences that will become apparent from the following description.

Device 111 includes body 121 having an interior chamber 123, one or more cables 125 (one shown for simplicity), and a locking device (not shown). The cable 125 is released from a spool 131 in body 121 through a central hole 129 located at the upper end of body 121. The cable extends continuously from spool 131 to the locking device, but first makes a circuitous path through a friction-inducing structure 133. Structure 133 comprises a box having a plurality of horizontal, parallel, cylindrical rods 135 that are vertically spaced apart from each other and rigidly secured in structure 133. The cable 125 alternatingly weaves through rods 135 as the cable is unrolled from spool 131. As described above for device 11, the friction caused by the woven pattern of release of cable 125 through rods 135 generates sufficient friction to safely lower a person from any altitude in a structure 15 (see, e.g., FIG. 5) to the ground 17. Device 111 is also equipped with an optional braking mechanism 141 that operates in the same manner described above for braking mechanism 41.

The present invention has several advantages, including the ability to save the lives of people who are in imminent danger and have no safe way of escape from a tall building or other structure. The present invention is worn by a user, like a backpack, which is quickly attached to the body of the user with straps that are similar to seat belts. A cable extends from the safety device and the user simply attaches one end of the hardware to a secure object in the building from which the user will descend. The user then steps out of or leaps from the building (e.g., a window) and is slowly lowered by the device before safely traveling to the ground. If the user wishes to descend even more slowly, he or she may use an optional braking mechanism to do so.

While the invention has been shown or described in only some of its forms, it should be apparent to those skilled in the art that it is not so limited, but is susceptible to various changes without departing from the scope of the invention.

What is claimed is:

1. A personal rappel escape device comprising:

a body having an interior chamber, the body having a top surface, a bottom surface opposite of the top surface, a side surface connecting the top surface and bottom surface;

a harness attached and secured to the body, the harness having a top portion adjacent the top surface of the body and adapted to be secured to a torso adjacent one or more arms of a wearer, the harness further having a bottom portion adjacent the bottom surface and adapted to be secured to one or more legs of the wearer;

a spool mounted inside the interior chamber at a lower end of the body near the bottom surface, the spool being rotatable relative to an axis substantially perpendicular to a plane of the side surface of the body;

a cable having a proximal end secured to the spool and being wound on the spool so that the cable is adapted to be unspooled from the body and extend from an opening in the top surface of the body;

a releasable locking device secured to a distal end of the cable located outside of the top surface of the body and outside of the opening, the releasable locking device adapted to be secured to an anchor for supporting a weight of the wearer via the cable;

a box positioned within the body, extending inwardly from the top surface thereof into the interior chamber, and vertically positioned at a higher elevation within the interior chamber than the spool;

a braking system having at least a portion thereof mounted inside the interior chamber and adjacent the spool to selectively decrease a rate of descent of the wearer from an altitude by selectively controlling an amount of cable unrolled from the spool, the braking system including a friction brake and a brake handle, the friction brake positioned to engage a rear surface of the spool and the brake handle extending from the side surface of the body and being connected to the friction brake so that when the brake handle is pulled away from the side surface of the body by the wearer the friction brake pivots into contact with the rear surface of the spool and responsively engages the rear surface of the spool to decrease a rate of which the cable is released from the spool; and a lattice mounted inside the box, inside the interior chamber at a higher elevation than the spool, so that the cable on the spool is threaded between the lattice after being selectively controlled by the braking system so that the lattice dampens, via friction, the rate of descent of the wearer during operations thereof, the lattice comprising a plurality of non-rotating and fixedly secured cylindrical rods rigidly secured to the box and vertically spaced apart from each other along a vertically extending length of the body and adapted to be vertically spaced along an extending length of the torso of the wearer when mounted thereon, each of the plurality of cylindrical rods respectively defining an axis wherein each respective axis is orthogonal to the axis of rotation of the spool; and the box includes a bottom face having a pivot member to attach the friction brake and enable the friction brake to pivot into contact with the rear surface of the spool responsive to the brake handle being pulled away from the side surface of the body by the wearer, and the box further includes a bottom aperture where the cable can be fed through to the plurality of rods of the lattice and threaded therebetween after being selectively controlled by the braking system, the box being devoid of gears.

2. A personal rappel escape device as defined in claim 1, wherein each rod is rounded to avoid damage to the cable and increase a surface area of contact and friction with the cable.

3. A personal rappel escape device as defined in claim 1, wherein the body has a door for providing access to the interior chamber, and the harness is a multi-point harness comprising straps, clasps, and buckles adapted to be attached to the one or more arms, legs, and torso of the wearer.

4. A personal rappel escape device as defined in claim 1, wherein the body is a substantially rectangular shape and is adapted to be worn on the back or front of the torso of the wearer.

5. A personal rappel escape device as defined in claim 1, wherein the cable is comprised of a plurality of cables for redundancy.

6. A personal rappel escape device as defined in claim 1, wherein the cable is threaded between the plurality of the rods in a labyrinthine path.

* * * * *